US005839932A

United States Patent [19]

Pierce et al.

[11] Patent Number: 5,839,932

[45] Date of Patent: Nov. 24, 1998

[54] MULTI-PURPOSE AQUATIC RESCUE GEAR

[76] Inventors: William D. Pierce, 1436 Banbury Rd., Raleigh, N.C. 27607; Kenney J. Pierce, Jr., 955 Opal St., San Diego, Calif. 92109

[21] Appl. No.: 923,409

[22] Filed: Sep. 4, 1997

[51] Int. Cl.[6] ..... B63C 9/00

[52] U.S. Cl. ..... 441/80; 441/84

[58] Field of Search ..... 441/80, 81, 84, 441/85, 88, 106–119, 125

[56] References Cited

U.S. PATENT DOCUMENTS

| | | | |
|---|---|---|---|
| 2,451,475 | 10/1948 | Craig et al. . | |
| 2,615,182 | 10/1952 | Podell . | |
| 2,716,245 | 8/1955 | Desjarlais et al. . | |
| 4,360,351 | 11/1982 | Travinski . | |
| 4,626,221 | 12/1986 | Rocco . | |
| 5,037,341 | 8/1991 | Howard . | |
| 5,348,504 | 9/1994 | Pierce et al. . | |
| 5,393,254 | 2/1995 | Ducheshe | 441/108 |
| 5,466,179 | 11/1995 | Jeffrey, Sr. | 441/108 |
| 5,516,233 | 5/1996 | Courtney | 441/106 |

*Primary Examiner*—Ed L. Swinehart
*Attorney, Agent, or Firm*—Dowell & Dowell, P.C.

[57] ABSTRACT

A buoyant aquatic life-saving assembly including a portable waist belt having a plurality of storage pouches in which rescue gear is stored and from which the gear may be released during emergencies. At least one storage pouch houses an inflatable life belt designed to encircle an individual during water rescue and which incorporates a lift harness and a second pouch contains a throw line adapted to allow both fixed anchoring of the rescue gear or casting of the inflatable life belt. In a preferred embodiment, one or more storage pouches are on the buoyant waist encircling belt for storing additional rescue equipment.

19 Claims, 6 Drawing Sheets

Fig. 1
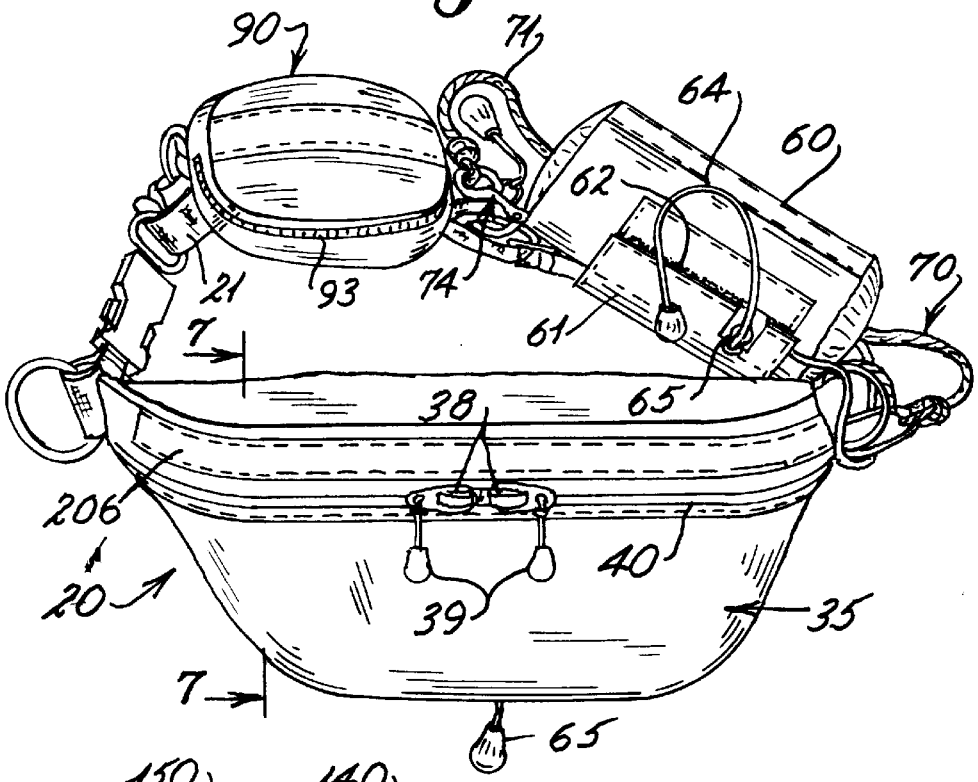
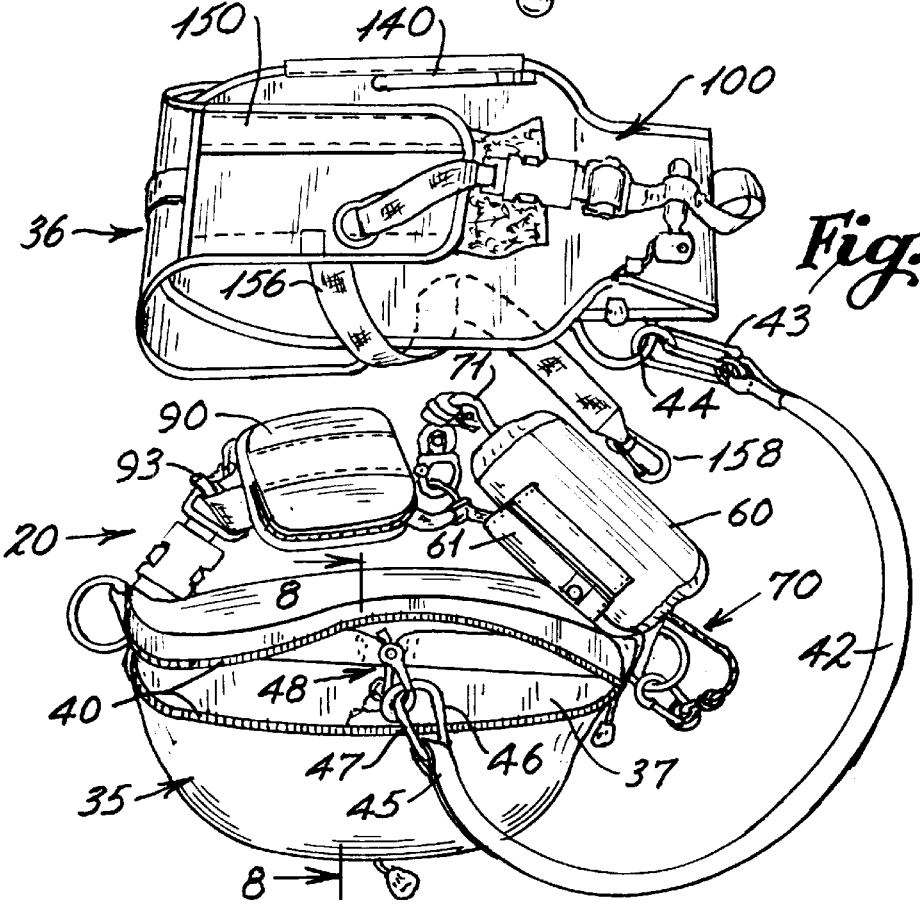
Fig. 2

Fig. 13
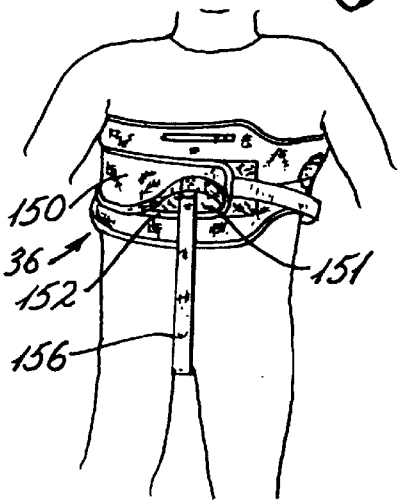
Fig. 14
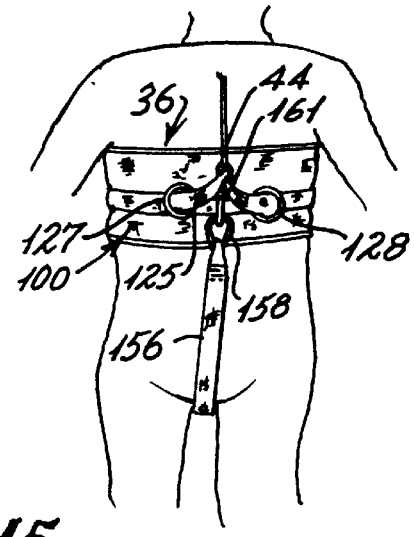
Fig. 15
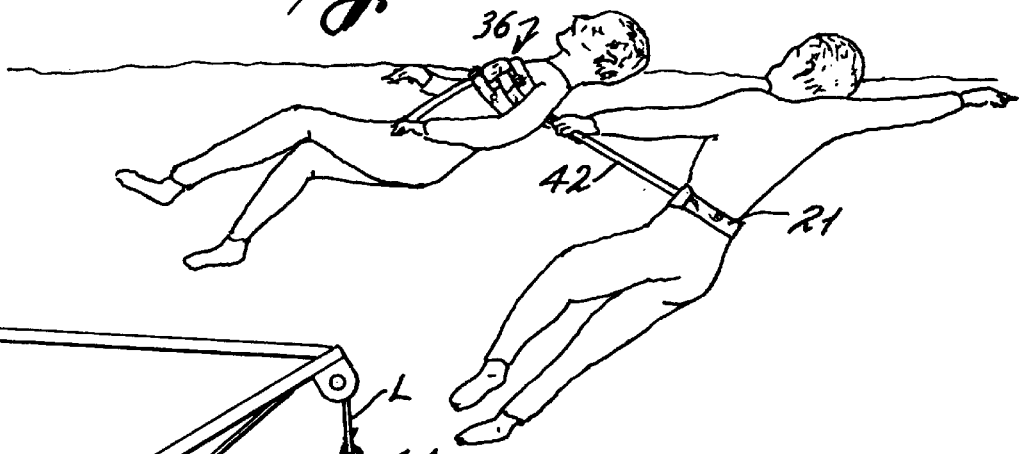
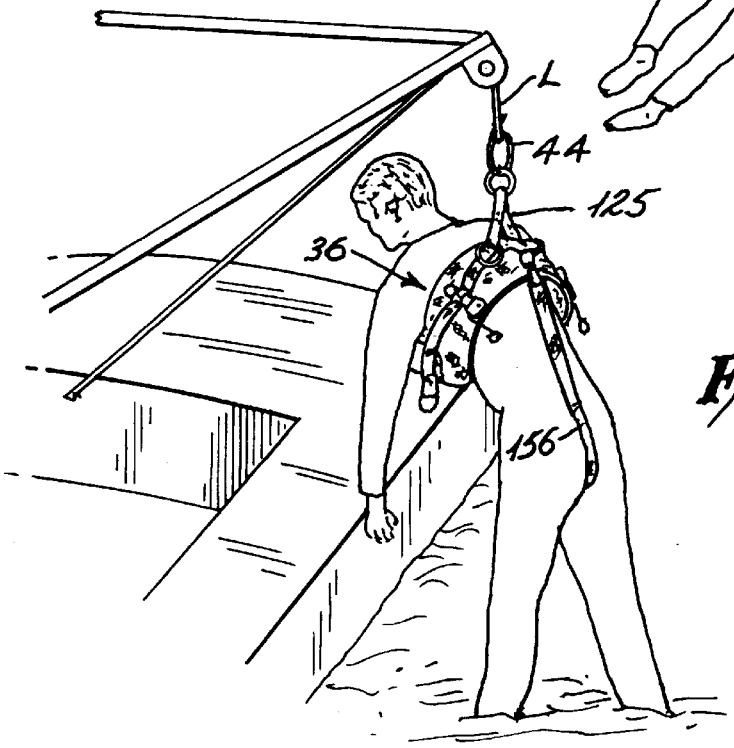
Fig. 16

MULTI-PURPOSE AQUATIC RESCUE GEAR

BACKGROUND OF THE INVENTION

1. Field of the Invention

This invention is generally directed to life-saving equipment of a type utilized in aquatic environments and, more specifically, to a multi-purpose portable belt and storage pouch assembly for storing rescue gear including an inflatable belt, harness and a throw line. The inflatable life-saving belt, harness and throw line may be quickly released from their storage pouches to allow for emergency casting of the life-saving belt or emergency hook-up of the throw line to facilitate rescue efforts. The invention is further directed to improvements in life-saving belts of a type which are designed to encircle the body of a victim which is designed to provide face-up flotation and which may be quickly converted to a harness for purposes of hoisting a victim from the water.

2. History of the Related Art

In the field of water rescue and safety, there are a number of conventional devices which have been designed to facilitate victim flotation and emergency extraction of a victim from the water. The most basic life-saving equipment is designed to be utilized by casting a flotation device to a victim in the water. Conventional life-saving rings constructed of buoyant materials are standardly utilized at swimming pools, other private and public swimming areas and on watercraft. In some instances, such life-saving rings are tethered to a throw line, allowing the rings to be pulled back to a side of a pool, shore or the deck of a boat once a victim has appropriately grasped the flotation ring. Such rescue equipment is generally only used where a life-saving victim has sufficient presence of mind to grasp the flotation device when it is thrown into the water.

In many instances, victims in the water cannot control their movement, thus requiring a rescuer to enter the water and make physical contact with the victim. In order to protect the welfare of the rescuer, most rescuers are provided with flotation equipment which they carry with them when making a water rescue. This allows additional flotation to maintain victim buoyancy. In some instances, however, simple flotation devices are not sufficient. Often, it is of benefit to have life-saving equipment which can be easily adapted or fitted to the victim and thereafter inflated to provide buoyancy for the victim in such a manner that the rescuer is free to maneuver the victim without the victim's interference. In rescue efforts, if a victim grabs a rescuer, both the rescuer and victim may be placed into a potentially life-threatening situation.

In applicants' previously issued patent, U.S. Pat. No. 5,348,504, an inflatable life-saving apparatus is disclosed which was specifically designed to assist rescuers by providing an inflatable flotation device which could be easily placed around the upper torso of a victim and beneath their arms in such a manner that the victim is assured of floating in a face-up position. The apparatus also assured that the rescuer could remain out of the victim's grasp by allowing the rescuer to approach and then maneuver the victim from the rear. The teachings of U.S. Pat. No. 5,348,504 are hereby incorporated herein by reference.

Often, it would be of benefit to rescuers to immediately determine whether a water rescue is necessary or whether a land rescue may be made with respect to a given victim. In this respect, it would be necessary for the rescuer to immediately have access to either equipment which may be utilized for casting from the shore, the side of a pool or the deck of a boat or equipment which could be carried by the rescuer if a water rescue is necessary. In addition, it would be beneficial if a single assembly could be provided to the rescuer which would also facilitate the ability to extract victims from the water after they had been buoyantly stabilized through the application of an inflatable life-saving belt. This would allow for lifting of a victim from the water when necessary. Unfortunately, current land-type rescue devices and water-type rescue devices have separate status and there are not adequate provisions in the art to allow for different types of rescues to be carried out utilizing a single, compact rescue apparatus.

SUMMARY OF THE INVENTION

The present invention is directed toward multi-purpose water rescue equipment which includes a belt designed to be worn by a rescuer to which is secured a plurality of separate packs. An inflatable life-saving belt is compactly stored within one pouch and is normally retained therein by a quick release mechanism which is operable exteriorly of the pack to allow the inflatable life-saving belt to be quickly separated from the pack for either casting to a victim needing assistance in the water or to release the inflatable life-saving belt after a rescuer has reached a victim in a water rescue and successfully applied the inflatable belt to the victim. A tether is provided between the inflatable life-saving belt and the quick release mechanism of the pouch which, when extended from the pouch, will allow the rescuer to tow the victim without being encumbered by any flailing movement of the victim. The inflatable life-saving belt also functions as a rescue harness, allowing a victim to be lifted from the water. The device includes a separate crotch strap which can be deployed beneath the victim's crotch and attached to a ring mounted to the back portion of the inflatable life-saving belt. Thereafter, the hoist strap can be used to lift the victim from the water with the aid of an appropriate hoist or crane.

The life-saving assembly also includes a second pouch in which a throw line is stored. One end of the throw line is attached to an emergency release which is operable by a pull-ring positioned outside of the pouch. This allows the throw line to either be retained attached to the life-saving belt when it is desired to tether the rescuer to a solid object or another person before the rescuer enters the water or allows the throw line to be released for throwing in the event it becomes necessary due to rescue circumstances in the water. A second quick release mechanism is also provided to allow the throw line storage pouch to be released from the life-saving belt pack when necessary.

In a preferred embodiment, the portable assembly further includes one or more additional storage pouches in which $CO_2$ cartridges and other life-saving gear may be selectively stored for ready access by the rescuer.

The pouches associated with the waist belt assembly are constructed with a buoyant inner material layer such that the entire waist belt assembly, including the inflatable life-saving belt/harness combination, throw line and other stored gear, will remain afloat when the waist belt assembly is in the water. This also facilitates the use of the life-saving gear by the rescuer during a water rescue.

It is a primary object of the present invention to provide a multi-purpose aquatic life-saving assembly which may be worn by a rescuer and which is buoyant when placed in the water and which selectively allows the deployment of an inflatable life-saving belt and hoisting harness, an emergency throw line and the retention of related safety gear in a portable and compact configuration.

It is another object of the present invention to provide emergency aquatic life-saving gear which is portable and which allows for both land and water rescues as well as emergency lifting of an individual during a water rescue.

It is also an object of the present invention to provide multi-purpose life-saving equipment which incorporates a unique inflatable life-saving belt and lifting harness wherein the life-saving belt may be placed about the upper torso of a victim and thereafter fastened utilizing hook and loop fastening materials and subsequently inflated with the design of the life-saving belt being such that the inflation increases the fastening effect of the hook and loop fastening materials and wherein the life-saving belt is further designed to allow a hoist line to be attached along the back portion thereof so that a victim may be lifted from the water without the life-saving belt injuring the upper torso of the victim's body.

It is yet another object of the present invention to provide a multi-purpose apparatus for use in water rescues wherein various rescue gear may be quickly detached in the event it becomes necessary during a rescue.

BRIEF DESCRIPTION OF THE DRAWINGS

FIG. 1 is a top perspective view of the multi-purpose aquatic rescue apparatus of the present invention;

FIG. 2 is a top perspective view of the rescue gear shown in FIG. 1 showing the inflatable life-saving belt and lift harness deployed from a first storage pouch and being tethered to the waist pack by a quick release mechanism;

FIG. 13 is a front illustrational view showing the inflatable life-saving belt of the present invention mounted to a victim with the crotch strap deployed;

FIG. 14 is a rear view of the inflated life-saving belt showing the attachment of the crotch strap shown in FIG. 13;

FIG. 15 is an illustrational view of the inflatable life-saving belt of FIGS. 13 and 14 in use tethered to the waist pack secured about the rescuer; and FIG. 16 is an illustrational view showing the inflated life-saving belt utilized as a hoist harness to lift a victim from the water.

DESCRIPTION OF THE PREFERRED EMBODIMENT

Figure 3:
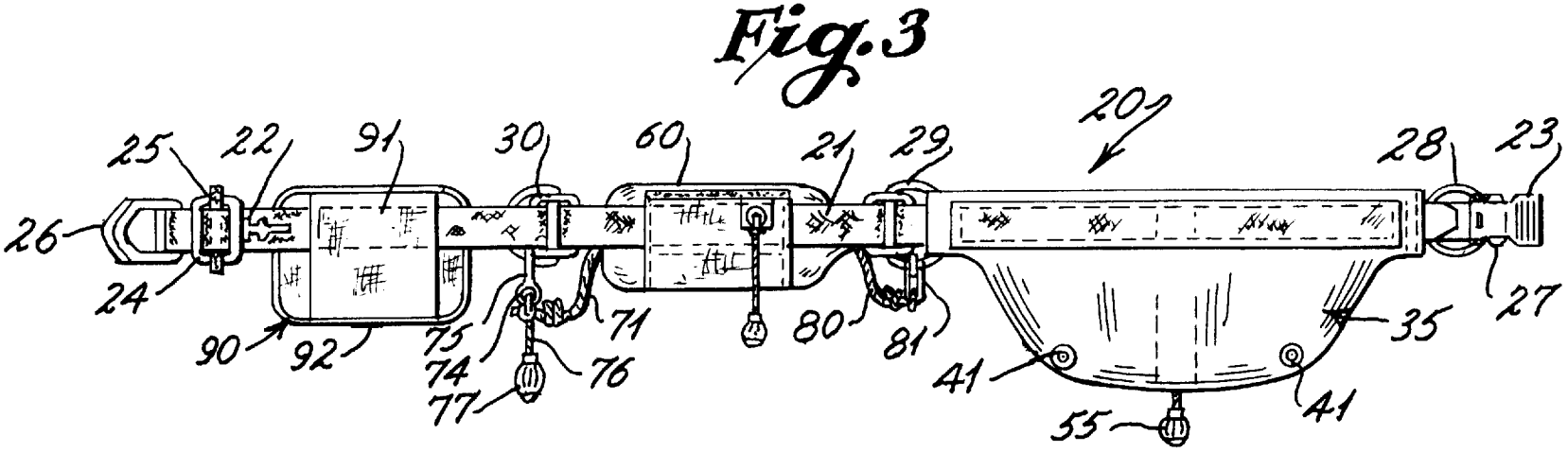
FIG. 3 is a side elevational inside view of the rescue waist pack shown in FIG. 1 in a fully extended position with all equipment being housed in the pouches associated therewith.

With specific reference to FIGS. 1–4, the present invention provides for a plurality of different water rescue gear to be conveniently stored in a waist belt pack assembly 20. The assembly includes a fabric belt 21 having a male buckle 22 and a female quick release connector 23. The buckle 22 includes a ring base portion 24 which extends through openings in the opposite ends of an adjustable lock bar or keeper 25 which is slidable with respect to the base portion to effectively secure the flexible strap in an adjusted position. The end of the belt includes a pull handle 26 utilized for providing quick adjustment to size the belt to the wearer as it is placed about the waist. The female quick release connector 23 includes a pair of release catches 27 which are pushed inwardly to immediately unlock the male buckle from the female connector.

Mounted in spaced relationship along the length of the belt 21 are a plurality of metallic D-rings 28, 29 and 30 which are used for purposes as will be described in greater detail hereinafter.

The waist pack assembly includes a first enlarged storage pouch 35 which is securely mounted to the belt 21 adjacent the female quick release connector 23 and serves to house an inflatable life-saving belt and lift harness assembly 36 which is shown deployed from an opening 37 in the pouch in FIG. 2. The opening 37 into the pouch is normally closed by a pair of zipper slides 38 having pull-cords 39 which, when pulled apart relative to one another, open the elongated zippered closure 40 to permit the deployment of the inflatable life-saving belt and harness assembly 36.

The inflatable life-saving belt 36 is normally connected interiorly of the pouch 35 by a tether or hoist strap 42 which includes a stainless steel snap type piece of hardware such as a hook 43 on the outer end thereof which is selectively engageable with the metallic D- or 0-ring 44 securely connected to the inflatable life-saving belt 36. The innermost end 45 of the tether strap 42 includes a stainless steel snap type piece of hardware such as a hook 46 having a spring closure 47 formed therewith mounted to a quick release latch mechanism or snap shackle 48 securely mounted within the pouch 35. The quick release snap shackle 48 and the manner in which the tether is connected to it and released therefrom is disclosed in detail in FIGS. 7–9. With respect to FIG. 7, the inflatable life-saving belt 36 is shown in a folded or rolled configuration within a chamber defined by the inner portion of the pouch 35. As shown in FIG. 8, the quick release snap shackle 48 includes a pivotal catch 49 which is normally engaged at its outermost end with a release pin 50 which is spring-loaded and normally extends through an opening in the end of the latch 49, retaining the latch in the closed position shown in FIG. 8. In this position, the snap hook 46 is disposed through the catch and is retained in position by the spring lock 47. A metallic connector ring 52 is mounted to the release pin 50 and is connected to a pull-cord 53 which extends through an opening 54 in the pouch to a pull-handle 55 outwardly of the pouch. The cord is covered by a fabric layer 51 within the pouch 35 which functions to prevent any interference with the operation of the snap shackle 48.

Figure 9:
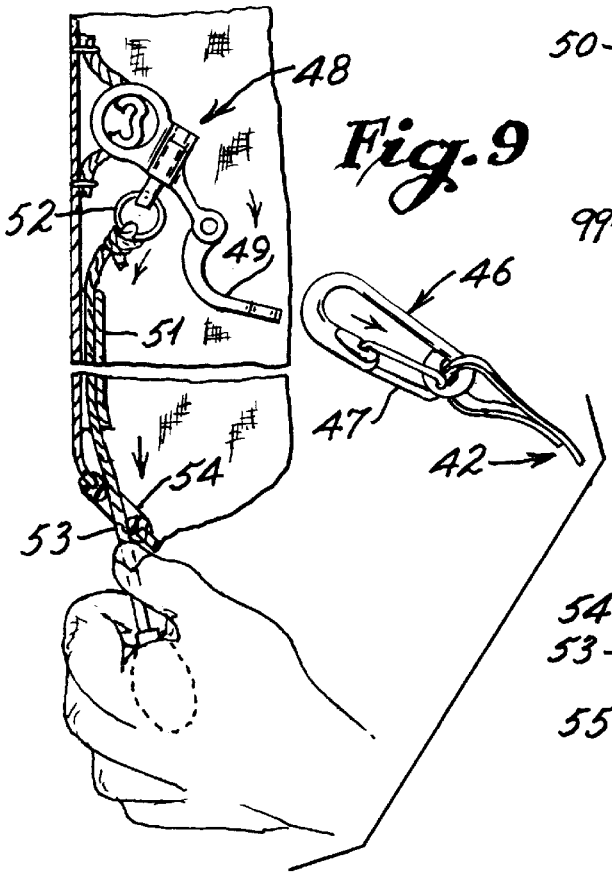
FIG. 9 is an illustrational view showing the release of the tether associated with the inflatable life-saving belt normally stored within the pouch as shown in FIG. 7.

As shown in FIG. 9, when necessary, the pull-handle 55 may be manually engaged and pulled downwardly as shown by the arrow in the drawing figure. This action pulls the release pin 50 away from the pivotal catch 49, allowing the catch to pivot to a fully open position, as shown in FIG. 9, thus automatically releasing the snap hook 46 and freeing the tether from the waist pack assembly. In use, when the inflatable life-saving belt is deployed, the belt will be retained by the catch 49 to the belt of the waist pack worn by the rescuer. When necessary, the tether strap 42 may be quickly released by pulling on the pull-cord 53, thus releasing the tether 42 and inflatable life-saving belt 36 from the waist pack assembly.

With particular reference to FIG. 3, it should be noted that a plurality of drainage openings are created in the bottom portion of the pouch 35 which are defined by circular grommets 41. The openings allow water which has collected within the pouch to easily drain from the pouch.

Again referring to FIGS. 1–4, the waist pack 20 of the present invention includes a second pouch 60 which is mounted intermediate the length of the belt 21 and which is secured to the belt by a moveable flap 61 which is secured to the exterior of the pouch 60 in such a manner that the flap 61 may be positioned on an opposite side of the belt 21 from the pouch 60. Hook and loop fastening materials provided on the inside of the flap and the outside of the pouch, as shown at 62, are utilized to removably mount the pouch 60 to the belt. To quickly detach the pouch 60 from the belt, a manual pull-cord 64 is securely attached at 65 to the flap 61. The cord includes a pull handle which is manually engageable in order to pull the flap to release the hook and loop fastening materials.

Mounted interiorly of the pouch 60 is a safety or throw line 70 having an inner end 71 which extends through an opening 72 formed in one end of the pouch. The inner end 71 of the throw line 70 is secured to a quick release mechanism 74 of the type described with respect to the quick release assembly 48. The quick release mechanism 74 includes a pivotable catch 75 which normally engages the metal D-ring 30 mounted to the belt 21. A pull-cord 76 is connected to the pull pin associated with the quick release mechanism 74 and includes a handle portion 77. By manually pulling on the handle 77 to pull the pull-cord 76, the pivot latch 75 is automatically released to allow the line to be immediately detached from the D-ring 30.

The opposite end 80 of the throw line 70 is connected to a snap hook 81 which is of the type described with respect to the snap hooks 43 and 45 associated with the tether strap 42. The snap hook 81 is normally mounted to the D-ring 29 and may be immediately released manually by urging the spring-loaded latching member inwardly of the hook catch. The front end 82 of the pouch 60 is normally gathered by a pull-cord (not shown) in such a manner that the end 82 may be easily opened to allow the immediate dispensing of the entire length of throw line 70 from the pouch with the exception of a segment which extends to the opposite end to the quick release mechanism 74.

In use, if a land rescue is contemplated, the snap hook 81 is removed from the D-ring 29 and engaged to the ring 44 which is secured to the inflatable life-saving belt 36. By securing the throw line to the life belt and releasing the strap 42 from the life belt, the inflatable life-saving belt 36 may be inflated and thereafter thrown to a victim who has sufficient composure in the water to grasp the inflated life-saving belt and retain themselves in a buoyant state within the water; afterwhich, the victim may be pulled utilizing the tethered throw line. For a water rescue, it may be advantageous to connect the snap hook 81 to a fixed structure or a person and thereafter allow the throw line to play out from the pouch 60 as the rescuer swims to the victim. This will allow the rescuer to utilize the line as a tether to pull the victim and rescuer to safety. If, at any time, it becomes necessary to release the line, the rescuer simply pulls on the handle 77 to release the quick release mechanism 75 from the D-ring 30.

The present invention also contemplates that additional water rescue equipment will be necessary including inflation cartridges which will be utilized with the life-saving belt 36. In this respect, at least one third pouch 90 is mounted to the belt 21. The pouch 90 includes a fixed mounting strap 91 through which the belt 21 extends to thereby allow the pouch 90 to be moved relative to the belt. The pouch 90 includes a zippered closure 93 which may be opened in order to obtain access therein. In a preferred embodiment, $CO_2$ cartridges 95 are mounted within spaced pockets or retaining straps 96 sewn within the pouch 90. Other life-saving equipment may be stored within the pouch 90. In order to facilitate drainage of water from within the pouch 90, at least one open grommet 92 is provided in the lower portion of the pouch, as shown in FIG. 3.

One of the unique features of the present invention is that the rescue pack assembly is designed to provide sufficient buoyancy to retain the belt, pouches and related gear afloat when dropped in the water. This feature also assists the rescuer by providing additional buoyancy to the rescuer wearing the equipment during a water rescue. Buoyancy is achieved by constructing each of the pouches described hereinabove with a central core material of buoyant material, such as a buoyant closed foam cell material. With specific reference to FIGS. 7 and 8, the pouch 35 for storing the inflatable life-saving belt 36 is shown in cross-section. The pouch 35 includes inner and outer water resistant fabric layers 98 and 99 between which is sandwiched a closed cell foam core 97. Similar construction is provided for the throw line pouch 60 and the auxiliary gear pouch 90. The closed cell foam material is sufficient to cause the entire rescue gear assembly to remain buoyant in the water, even when the inflatable life-saving belt 36 is not inflated and stored in the pouch 35.

With specific reference to FIGS. 5, 6 and 10–16, the structure and use of the inflatable life-saving belt will be described in greater detail. The initial deployment and release of the life-saving belt 36 from the pouch 35 has been previously described. The inflatable life-saving belt 36 includes an inflatable body or bladder section 100 having inner and outer fluid impervious material layers which are joined by an outer seam 101 which extends continuously around the body 100. The body defines a pair of enlarged inflation chambers at either end thereof, 102 and 103, respectively, and an intermediate inflation chamber 104 which is in open communication at either end with the inflation chambers 102 and 103. A heavy duty material belt 105 is secured at spaced locations 106, 107, 108 and 109 through the bladder and to the webbing or belts associated therewith. A pair of inflation valves 115 and 116 are mounted to openings (not shown) through the material layer 110 and are operable by pull-cords 117 and 118 to activate $CO_2$ cartridges 119 and 120 secured to the valves 115 and 116. The $CO_2$ cartridges are threadingly received within the valve assemblies 115 and 116 and, as previously discussed, replacement $CO_2$ cartridges may be maintained in the auxiliary gear pouch 90. A first fabric loop 121 is provided along a portion of the belt 105 for steadying the $CO_2$ cartridge 119.

A second fabric loop 122 is provided on a second or outer belt member which is secured at locations 106 and 108 to the underlying belt 105 and which belt 125 functions as part of a lift harness. The loops 121 and 122 as well as the $CO_2$ cartridges may be placed elsewhere depending upon the location of the inflation valves 115 and 116.

The central portion of the overlying belt 125 is formed into a loop 126 to which O-ring 44 is secured. Spaced outwardly on either side of the loop 126 are D-rings 127 and 128 which are fixedly mounted beneath the underlying belt 105. The overlying belt 125, which functions as part of a lift harness, extends through the D-rings 127 and 128 and the spacing of the D-rings is such as to limit the compression of the opposite ends of the body portion 100 when a force is applied to lift a victim by way of the ring 44 and belt 125 to which the inflatable life-saving belt has been attached, as shown in FIG. 16. The D-rings 127 and 128 prevent the belt 125 from squeezing and possibly forcing air from the victim's chest cavity by distributing the stress of any load being lifted by the outer belt through the O-ring 44 equally across the middle section 104 of the body 100 of the inflatable life-saving belt. However, the primary benefit of the belt 125 and associated rings is to provide an automatic "cinch" quality should a deflation of the life-saving belt bladder occur. This is accomplished by elongating the belt section defined between the ring 44 and rings 127 and 128, thereby reducing the length of the belt section defined outside of the ring which in turn causes a reduction of the circumference of the belt 125. The circumference of the belt 125 is directly related to the outer circumference of the bladder 100. During deflation, the outer circumference of the bladder is reduced but is compensated for by the belt 125 and rings 127 and 128.

Figure 6:
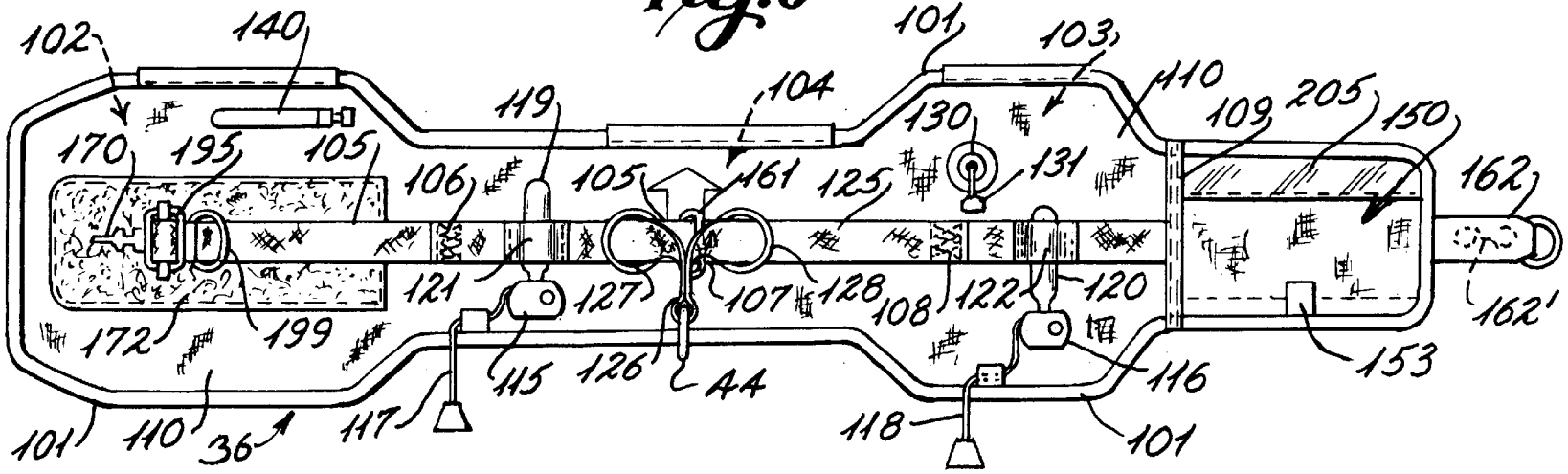
FIG. 6 is a top plan view of the inflatable life-saving belt of the present invention.

As shown in FIG. 6, an arrow is provided on the outer surface of the fabric 110 to ensure that the inflatable life-saving belt is aligned along the spine of a victim being rescued. It is necessary to ensure proper alignment to ensure the effectiveness of the life-saving belt and to prevent accidental injury to the victim during a water rescue. In the event the pressure of the inflatable body portion 100 must be decreased, a pressure regulation valve 130 is mounted to the body portion and includes a manual pull 131 for opening the valve to discharge air from the chambers 102, 103 and 104. In the event of failure of both $CO_2$ cartridges to effectively operate to inflate the body portion of the life-saving belt, a oral fill valve 140 is mounted through the outer fabric layer 110.

The inflatable life-saving belt is designed to have two types of securing mechanisms associated therewith. The first mechanism is a hook and loop fabric engagement system for immediately securing the life-saving belt to the victim. The second mechanism includes a mechanical male and female lock assembly associated both with the belt 105 and with an opposite end flap 150 extending from the inflatable end 103 of the body portion 100 of the belt. With reference to FIG. 13, the flap 150 is formed as an extension of the body portion 100 as shown in the drawing figures but does not define an inflatable chamber. The flap 150 defines an inner pouch or compartment 151 which is accessed through an elongated opening 152 which is normally closed by opposing hook and loop fastening materials. In order to effect a quick opening into the compartment 151, a pull tab 153, FIG. 6, is mounted on the outer fabric layer of the flap 150. Secured inside of the compartment 151 is a crotch strap 156. The strap is shown being deployed through the opening 152 in the flap 150 in FIG. 13 and in FIG. 2. Normally, the crotch strap is folded upon itself and stored within the compartment 151. Should it be necessary, however, the crotch strap is easily deployed in order to assist a victim when being lifted from the water, as shown in FIG. 16. As previously mentioned, the inner end of the strap is fixedly secured within the compartment 151 and is secured to the belt 105 which extends through the compartment 151 to an outer female quick release buckle mechanism 160. Extending from the end of the flap 150 is a pull-tab 162 which is used to apply the life-saving belt to a victim.

Figure 12:
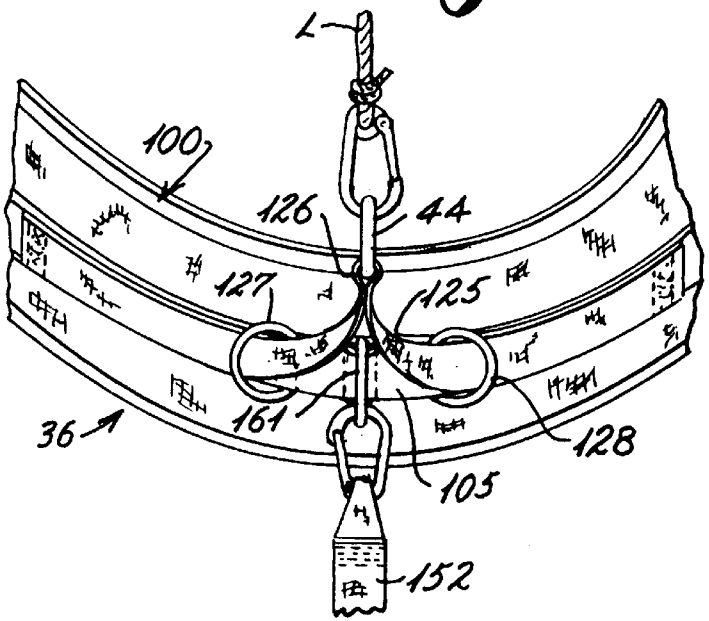
FIG. 12 is a partial rear view of the inflatable life-saving belt shown in a deployed position wherein the belt is utilized as a lifting harness.

The crotch strap 156 includes an outer end portion to which a snap hook 158 is secured. The snap hook 158 is designed to be engageable with a metallic ring 161 secured to the central portion of the belt 105 and intermediate the D-rings 127 and 128, as shown in FIGS. 6 and 12. With the strap being connected as shown in FIGS. 12 and 14, a hoist line "L" may be secured to the lift ring 44 and a victim may be raised from the water, as shown in FIG. 16. The crotch strap prevents the harness from accidentally slipping over and free of the victim's body.

Figure 5:
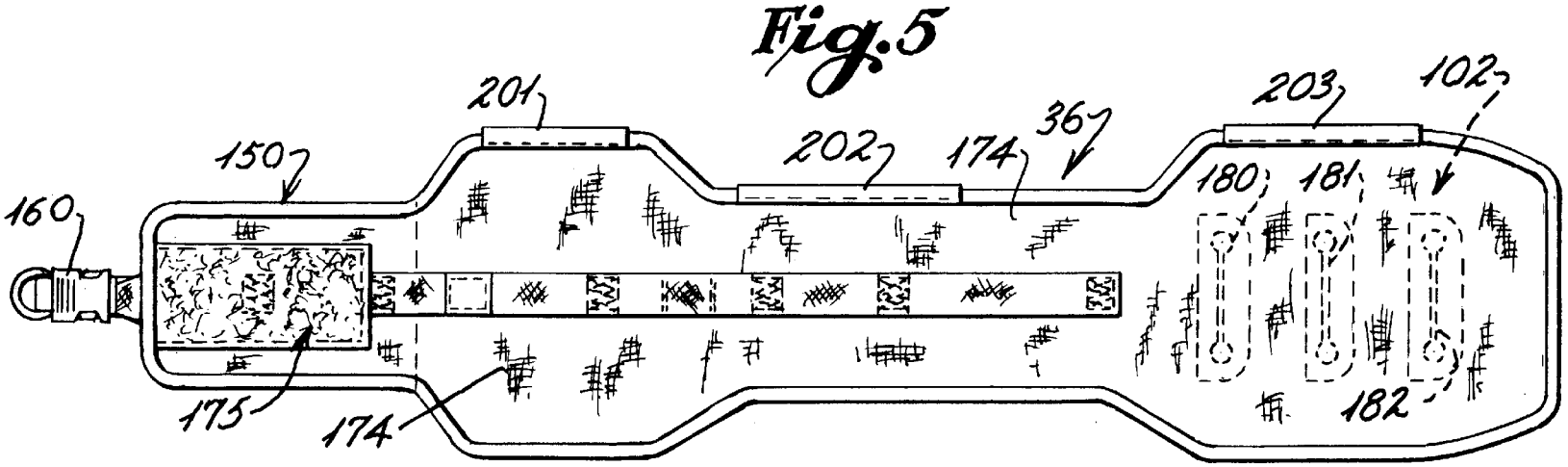
FIG. 5 is a bottom plan view of the inner surface of the inflatable life-saving belt of the present invention.
Figure 10:
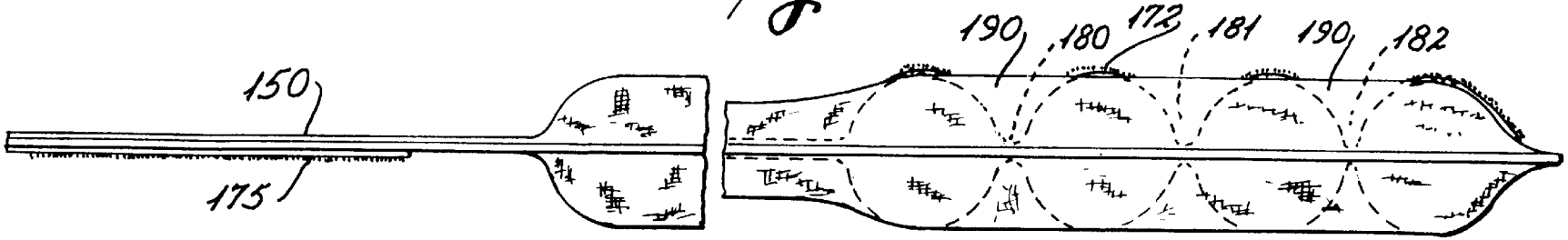
FIG. 10 is a partial cross-sectional view having portions broken away showing the inflation chambers along a portion of the inflatable life-saving belt of FIGS. 5 and 6.
Figure 11:
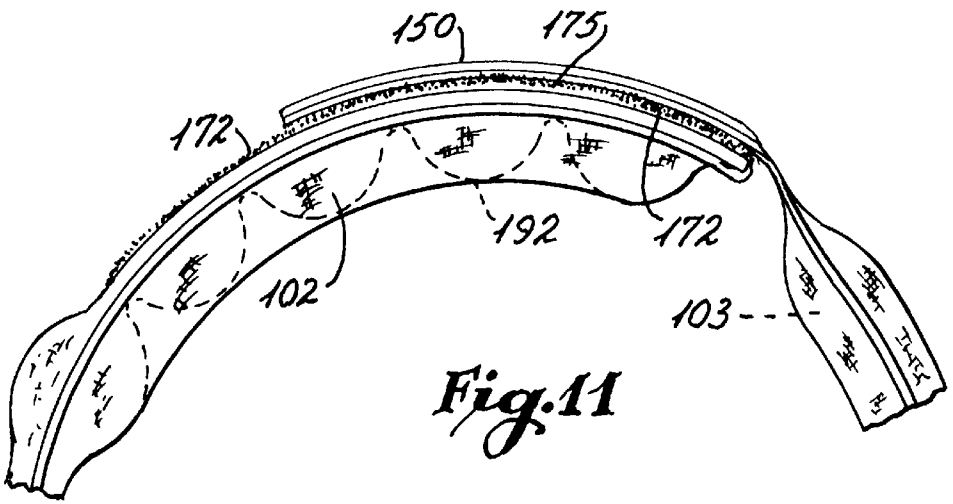
FIG. 11 is a view similar to FIG. 10 taken from the upper portion of the inflatable life-saving belt showing the manner in which the hook and loop fastening materials associated with the inflatable life-saving belt function to increase the locking engagement thereof when the belt is inflated.

As previously mentioned, the life-saving belt is designed to be initially placed about the victim using hook and loop fastening materials. In this respect, a large section of hook and loop fastening materials 172 is provided along the outer fabric layer of section 102 of the inflatable body of the life-saving belt, as shown in FIG. 6. With reference to FIG. 5, the inner surface 174 of the body portion of the belt and the inner surface of the flap 150 are shown. In this drawing figure, a hoop and loop fastening fabric surface 175 is provided along the flap 150 for selectively engaging with the hook and loop fastening material 172 provided on the outer surface along the opposite end of the body portion of the belt. As shown in FIG. 11, the flap 150 simply overlaps the portion 102 of the body 100 of the belt so that the hook and loop fastening material 175 mates with the material 172. Thereafter, the body portion is inflated, as shown in FIGS. 10 and 11.

In order to ensure that sufficient pressure is provided to secure the hook and loop fastening materials in place when the belt is inflated, the chamber of end portion 102 is divided by a plurality of spaced internal ribs or baffles 180, 181 and 182. The baffles are secured by appropriate adhesive and fabric welding to both the inner and outer fabric materials defining the inner inflatable chamber. The baffles function in a manner shown in FIGS. 10 and 11. The baffles limit the protrusion of the bladder, that is, its expansion as shown in FIG. 12 so as to control the amount of pressure placed on the chest of the victim by limiting the distance the bladder compresses the chest and to more uniformly apply the internal pressure over a greater surface area as shown in FIG. 11. The structure also provides a smoother, less arched surface for the hook and loop fasteners to adhere to retain the life-saving belt in place and also provide greater surface area contact with the chest of the victim to thereby improve the grip of the life-saving belt to the victim and thus reduce slippage of the belt during use. In FIG. 10, if the belt is inflated in the position shown at FIG. 5, the baffles create indentations in the surface as shown at 190.

Once the belt has been applied utilizing the hook and loop fastening materials 172 and 175, the belt 105 is secured about the body portion of the inflatable life-saving belt, as shown in FIG. 15. The male latch 170 is thereafter inserted within the female latch member 160 and the belt adjusted by pulling on the ring 199 until sufficient adjustment has been made to secure the belt to the victim.

In use, as shown in FIG. 15, it is possible for the rescuer to utilize the strap 42, which extends from the belt 21 within the pouch 45 to the metallic lift ring 44, when pulling a victim through the water. This allows the rescuer to be free from any interference from the victim. If it is necessary to hoist the victim from the water, the strap 42 is either disconnected from the belt 21 or from the ring 44 and an appropriate hoist line attached to the ring 44 after which the belt 105 is disconnected and the victim if lifted as shown in FIG. 16.

With particular reference to various drawing figures, it should be noted that the overall design of the waist belt pack assembly and life-saving belt is such as to promote error free operation even in situations where the rescuer must operate various components of the waist belt pack assembly or of the inflatable life-saving belt without being able to see the various operating mechanisms. By way of example, the knobs associated with each of the release devices and with the inflation valves and regulation valve are each configured so as to be ergonomically compatible and of a different configuration so that the rescuer may determine, by feel that an appropriate handle has been grasped. The enlarged handle 55 associated with the release mechanism for the life-saving belt is shown as being slightly larger including horizontal bands or recesses. The zippered fasteners for gaining access into the pouch 35 show generally rectangular knobs or handles at the ends thereof. The rescue line or throw rope is configured to have generally bulbous type handles associated therewith with vertically extending grooves or ridges. The handles associated with the inflation valves 115 and 116 are shown as being somewhat triangular or truncated in configuration whereas the handle associated with the pressure regulating valve 130 is generally round in configuration.

Figure 4:
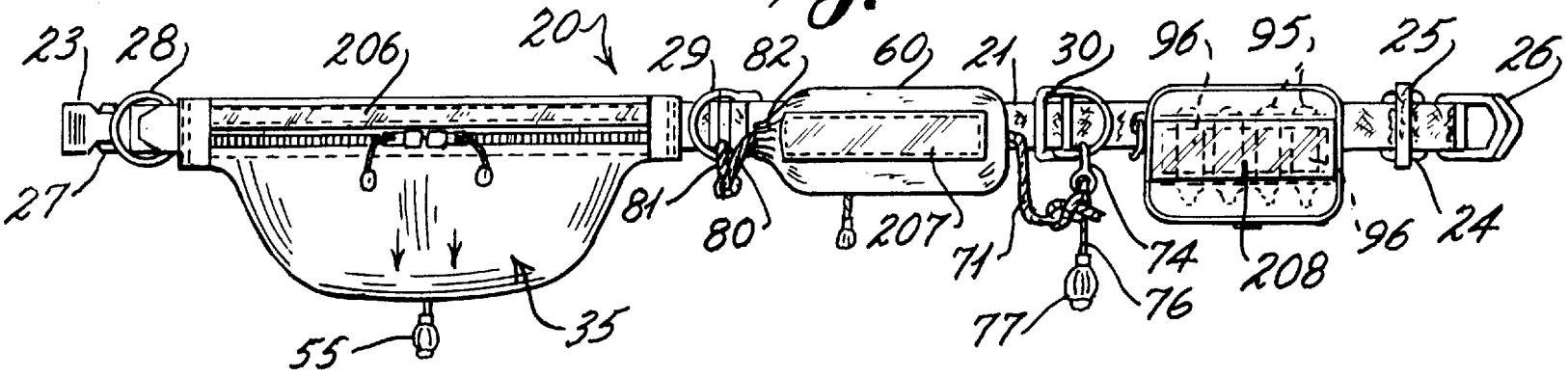
FIG. 4 is a view similar to FIG. 3 taken from the outside of the rescue waist pack of FIG. 1.

In order to further assist in rescue efforts and to make the waist pack assembly of the present invention visible in poor light conditions, reflective tape material is applied at various portions of the life-saving gear. By way of example, strips of reflective material are applied such as at spaced locations along the upper edge of the life-saving belt 36 as shown at 201, 202 and 203 in FIG. 5. In addition, reflective material is applied along the flap 150, as shown at 205 in FIG. 6. To provide light reflection for the overall waist pack assembly, further reflecting materials are provided at 206 along the upper portion of the pouch 35, by way of a strip 207 applied along the length of the throwline pouch 60 and a further strip 208 applied to the outer surface of the supplemental pouch 90, as shown in FIG. 4.

To make the life-saving belt 36 easy to tow through the water in a rescue attempt, and in order to easily facilitate the compact storage of the rescue belt within the pouch 35, the belt is designed to be rolled upon itself and secured utilizing a hook and loop fastener material patch which is applied to the underside of strap 162, shown at 162' in FIG. 6. This hook and loop fastening material which may be Velcro™ is secured to the large hook and loop fabric area 172 on the opposite end of the belt after the belt has been rolled up, thereby maintaining the belt in a tightly rolled configuration.

Figure 7:
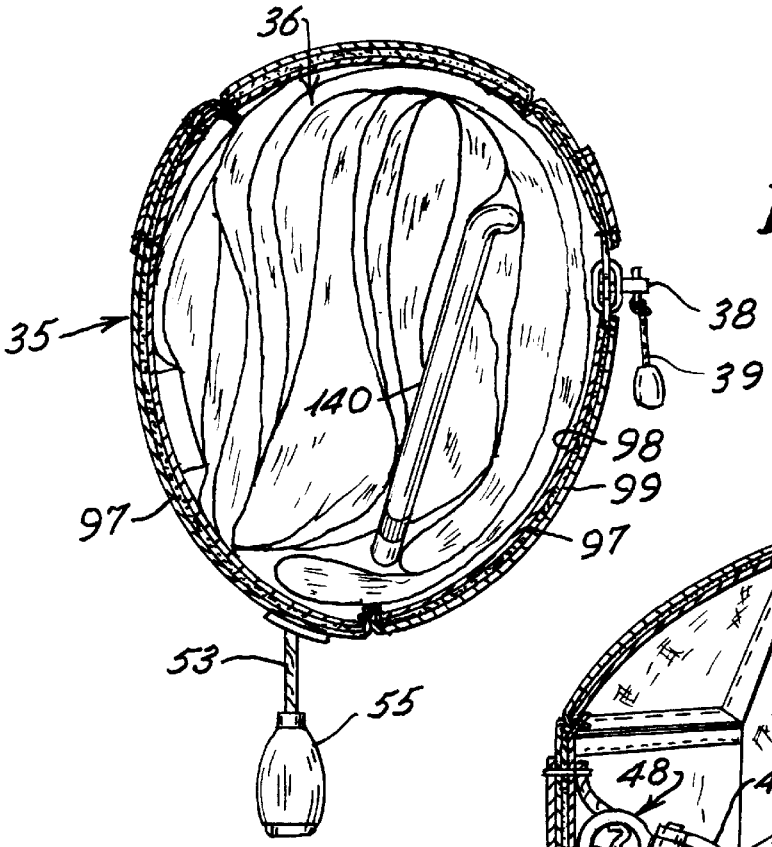
FIG. 7 is a cross-sectional view taken along line 7—7 of FIG. 4 showing the inflatable life-saving belt in a stored position within a pouch of the waist pack.
Figure 8:
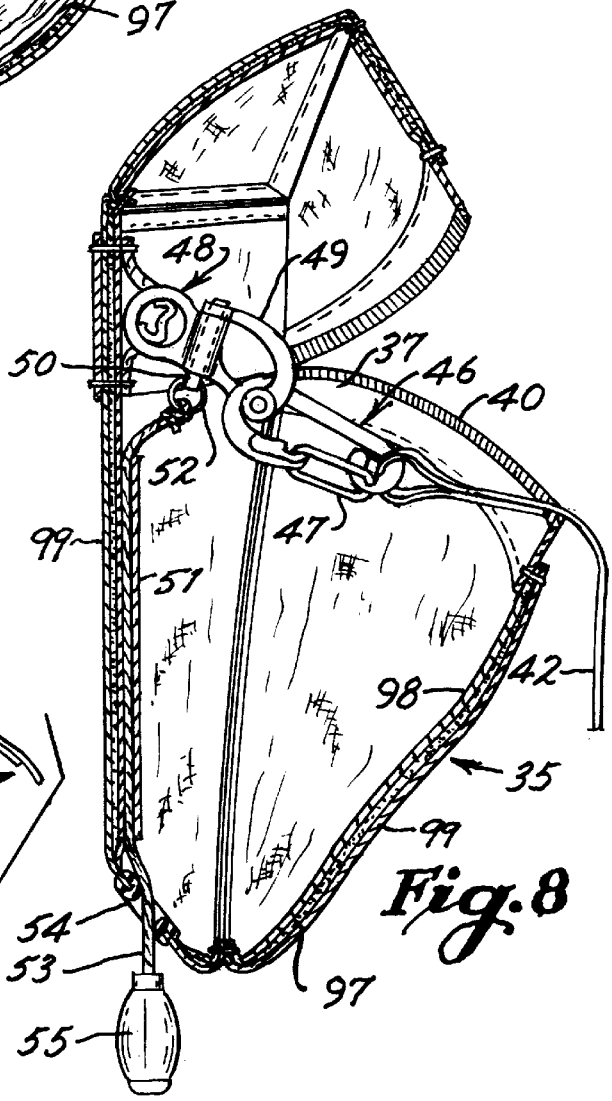
FIG. 8 is a view similar to FIG. 7 showing the pouch open and the inflatable life-saving belt being deployed but being tethered to a quick release mechanism mounted within the pouch so that the inflatable belt remains connected to the waist pack.

With continued reference to FIG. 6, life-saving belt is also designed so that the components of the belt do not interfere with one another when in the rolled or stored configuration as shown in FIG. 7. Therefore, each of the operating valves, various "D" and "O" rings, inflation valves and pressure regulating valve are offset with respect to one another along the length of the life-saving belt. When the belt is rolled, the components will not stack upon one another in a rolled configuration, thereby reducing the bulk of the belt in a rolled and stored configuration.

With particular reference to FIG. 15, the life-saving belt 36 is also designed to encircle the body of the victim in such a manner that a supplemental cervical collar may be easily placed about the neck of the victim to provide further flotation without interference from the life-saving belt. Further, the belt positions the head of the victim in such a manner that application of water rescue breathing is possible while both the rescuer and victim are in the water as the head and neck are disposed at a proper angle to facilitate mouth-to-mouth resuscitation.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A portable life-saving apparatus for use in aquatic environments comprising:

a waist pack including a belt for encircling a body and having a first pouch attached thereto in which an inflatable life-saving belt and lifting harness is enclosed in a deflated condition;

a tether strap mounted to said inflatable life-saving belt and lifting harness and to said belt;

a first manual release means for selectively detaching said life-saving belt and lifting harness from said belt;

a second pouch mounted to said belt in which a throw line is stored; and a second manual release means connected to said belt for selectively detaching said throw line from said belt.

2. The portable life-saving apparatus of claim 1 including a third manual release means for removably securing said second pouch to said belt.

3. The portable life-saving apparatus of claim 2 in which said third manual release means includes a first hook and loop fabric engaging material secured to an exterior surface of said second pouch, a flap member having hook and loop fabric engaging material secured thereto for mating with the hook and loop fastening material secured to said second pouch, and a pull line mounted to said flap and extending outwardly therefrom, said flap being normally mounted in covering relationship with respect to said belt.

4. The portable life-saving apparatus of claim 2 wherein said throw line includes an inner end extending through an opening in said second pouch, and said inner end being secured to said second manual release means.

5. The portable life-saving apparatus of claim 4 including at least one additional pouch mounted to said belt, and each of said first, second and at least one additional pouches being constructed having outer material layers and inner buoyant material layers, whereby the life-saving apparatus is buoyant in water.

6. The portable life-saving apparatus of claim 5 in which said one additional pouch includes an inner cavity, a plurality of strap retaining members mounted within said cavity adapted to retain items therein.

7. The portable life-saving apparatus of claim 1 in which said first manual release means includes a first quick release snap shackle mounted within said first pouch for normally engaging a first snap hook mounted to one end of said tether strap, and a first pull cord means extending outwardly of said pouch for releasing said first snap shackle to release said first snap hook of said tether strap.

8. The portable life-saving apparatus of claim 7 wherein said second manual release means includes a second quick release snap shackle mounted to said belt adjacent said second pouch, said throw line including an inner end having a second snap hook mounted thereto for selectively engaging said second snap shackle, and a second pull cord means extending from said second snap shackle for selectively releasing said second snap hook of said throw line from said second snap shackle.

9. The portable life-saving apparatus of claim 8 including a third manual release means for removably securing said second pouch to said belt.

10. The portable life-saving apparatus of claim 1 wherein said inflatable life-saving belt and lifting harness includes a body having first and second outer inflatable end portions and an intermediate inflatable portion, a flap member extending outwardly from said first end portion of said body, and securing means for securing said flap member to said second end portion of said body when said inflatable life-saving belt is placed around the upper torso of an individual.

11. The portable life-saving apparatus of claim 10 wherein said flap member includes an inner compartment, said lifting harness including a strap member having one end secured within said compartment and an opposite end deployable exteriorly thereof, a fourth manual release means for opening said compartment in said flap member to thereby deploy said strap member therefrom, and said strap member having a remote end having a fastener for securing to said inflatable life-saving belt along said intermediate portion of said body.

12. The portable life-saving apparatus of claim 11 including an inner belt member extending along and secured to said intermediate portion of said body and along a exterior surface thereof, said harness including an outer belt member having opposite end portions secured in spaced relationship with respect to one another to said intermediate portion of said body along said exterior surface thereof, a lifting ring member mounted to said outer belt member intermediate the length thereof and between said end portions and being moveable outwardly with respect to said exterior surface, and a pair of secondary ring members secured on opposite sides of said lifting ring member to said exterior surface of said body through which said outer belt member extends, said secondary ring members serving to distribute forces applied upon the lifting ring member when said inflatable life-saving belt is disposed about the upper torso of an individual and the individual lifted utilizing a hoist attached to said lifting ring member.

13. The portable life-saving apparatus of claim 12 including an intermediate ring member mounted between said spaced secondary ring members, said intermediate ring member being secured to said outer belt of said inflatable life-saving belt, and said strap member including an outer snap shackle member for engaging said intermediate ring after said strap member has been deployed from said compartment of said flap member whereby said strap member is adapted to extend from a front portion of said inflatable life-saving belt defined by said flap portion when applied to an individual downwardly and beneath the crotch of the individual and upwardly to said intermediate ring member.

14. The portable life-saving apparatus of claim 13 including at least one valve means mounted to said body of said inflatable life-saving belt, and at least one gas cartridge means secured to said at least one valve means for supplying pressurized gas for inflating said intermediate and first and second end portions of said body.

15. The portable life-saving apparatus of claim 14 including a pressure regulating valve mounted to said body, and manual pull means for activating said pressure release valve for deflating said intermediate and first and second end portions of said body.

16. The portable life-saving apparatus of claim 13 in which said body includes inner and outer fluid impervious layers, a plurality of spaced internal baffles secured between said internal and external surfaces of said body along said first end portion of said body for dividing said first end portion into a plurality of sections which are in fluid communication with one another when inflated.

17. The portable life-saving apparatus of claim 13 wherein said securing means for securing said inflatable life-saving belt includes a second hook and loop fastening material applied to said outer surface of said second end portion of said body and a third hook and loop fastening material extending along an inner surface of said flap member, said third hoop and look fastening material of said flap member being selectively engageable with said second hook and loop fastening material of said second end portion of said body.

18. The portable life-saving apparatus of claim 17 in which said securing means includes a separate mechanical fastening element secured to said inner belt and having a first portion extending outwardly from said flap member and a second portion extending along said second end portion of said body.

19. The portable life-saving apparatus of claim 1 including at least one additional pouch mounted to said belt, and each of said first, second and at least one additional pouches being constructed having outer material layers and inner buoyant material layers, whereby the life-saving apparatus is buoyant in water.

* * * * *